US007934583B2

(12) United States Patent
Reuther et al.

(10) Patent No.: US 7,934,583 B2
(45) Date of Patent: May 3, 2011

(54) HOUSINGS FOR FLUE GAS UNITS

(75) Inventors: Georg Reuther, Hochstadt (DE); Juergen Rickertsen, Lambrecht (DE)

(73) Assignee: Heinrich Gillet GmbH, Edenkoben (DE)

( * ) Notice: Subject to any disclaimer, the term of this patent is extended or adjusted under 35 U.S.C. 154(b) by 0 days.

(21) Appl. No.: 12/182,319

(22) Filed: Jul. 30, 2008

(65) Prior Publication Data

US 2009/0032332 A1 Feb. 5, 2009

(30) Foreign Application Priority Data

Aug. 2, 2007 (DE) ..... 20 2007 010 754 U

(51) Int. Cl.

| | |
|---|---|
| ***F01N 13/18*** | (2010.01) |
| ***F01N 13/08*** | (2010.01) |
| ***F01N 13/00*** | (2010.01) |
| ***F01N 1/02*** | (2006.01) |

(52) U.S. Cl. ..... 181/282; 181/227; 181/228; 181/239; 181/249

(58) Field of Classification Search ..... 181/282, 181/227, 228, 239, 249

See application file for complete search history.

(56) References Cited

U.S. PATENT DOCUMENTS

| | | | | |
|---|---|---|---|---|
| 1,353,863 | A * | 9/1920 | Taber | 181/282 |
| 2,194,928 | A * | 3/1940 | Doyle | 123/41.31 |
| 2,739,661 | A * | 3/1956 | Powers | 181/276 |
| 3,116,803 | A * | 1/1964 | Buchwald | 180/309 |
| 3,251,174 | A * | 5/1966 | Jafs | 96/355 |
| 3,419,107 | A * | 12/1968 | Jozepaitis | 181/240 |
| 3,776,366 | A * | 12/1973 | Betts et al. | 181/239 |
| 3,822,991 | A * | 7/1974 | Mutchler | 432/223 |
| 3,853,201 | A * | 12/1974 | Smale | 181/265 |
| 4,022,291 | A * | 5/1977 | Stephenson | 181/239 |
| 4,094,645 | A * | 6/1978 | Bailey | 422/180 |
| 4,547,942 | A * | 10/1985 | Fukuda | 29/890.08 |
| 4,759,423 | A * | 7/1988 | Harwood et al. | 181/282 |
| 5,259,797 | A * | 11/1993 | Miles et al. | 440/89 R |
| 7,104,359 | B1 * | 9/2006 | Zelinski | 181/264 |
| 7,316,292 | B2 * | 1/2008 | Morales et al. | 181/282 |
| 7,374,016 | B2 * | 5/2008 | Yamaguchi et al. | 181/249 |
| 2005/0133301 | A1 * | 6/2005 | Butterfield et al. | 181/275 |
| 2008/0196969 | A1 * | 8/2008 | Henke et al. | 181/212 |

FOREIGN PATENT DOCUMENTS

DE 10 2005 026 376 A1 12/2006

* cited by examiner

*Primary Examiner* — Jeffrey Donels

*Assistant Examiner* — Christina Russell

(74) *Attorney, Agent, or Firm* — Muncy, Geissler, Olds & Lowe, PLLC

(57) ABSTRACT

A housing for a flue gas unit is provided that includes a closed jacket and two end walls as well as an insert with inlet pipe an outlet pipe and retaining walls, wherein one of the pipes exits from the housing jacket radially. The housing jacket is cut out around the one pipe, the cutout is closed by a concave closing panel adapted to the shape of the cutout, and the closing panel has an opening for the radial pipe end.

3 Claims, 1 Drawing Sheet

HOUSINGS FOR FLUE GAS UNITS

This nonprovisional application claims priority under 35 U.S.C. §119(a) to German Patent Application No. DE 20 2007 010 754.4, which was filed in Germany on Aug. 2, 2007, and which is herein incorporated by reference.

BACKGROUND OF THE INVENTION

1. Field of the Invention

The invention relates to housings for flue gas units.

2. Description of the Background Art

Housings for flue gas units contain, for example, a muffler, a catalyst, a diesel soot particle filter, etc. They include a closed and gas-tight housing jacket and two end elements, designed either as flat-ended panels or as cones. At least one inlet pipe leads into the housing, and at least one outlet pipe leads out of the housing. In the great majority of cases inlet and outlet pipes are arranged such that they penetrate the end walls. In particular cases, however, it is necessary and known that at least one of the pipes radially penetrates the housing jacket. For this purpose a hole is made in the housing jacket. After the pipe has been introduced through the hole, the pipe and the housing jacket are connected gas-tight, preferably welded. See, for example, DE 10 2005 026 376 A1.

One drawback of this housing form is the complicated, time-consuming and thus also expensive installation process. The radial pipe must be placed through the opening in the housing jacket separately after installation of the other internal parts, connected in the interior of the housing with a holder provided there, and finally welded gas-tight with the housing jacket.

However, if the inlet and outlet pipes, as explained above, travel in the longitudinal direction of the housing, so that they penetrate the housing only in the area of the face ends, they can be prefabricated completely outside the housing together with the other elements to be provided in the interior of the housing, for example, transverse walls, overflow pipes, Helmholtz resonators, damping wool, etc. Then the prefabricated insert only has to be slid into the housing from one of the open housing ends. After placement of the second front end or cone, the flue gas unit element is complete.

SUMMARY OF THE INVENTION

It is therefore an object of the present invention to provide a housing for flue gas units in such a manner that even in the case of radial pipe passage the complete unit can be prefabricated externally and then slid as a whole into the housing.

In an embodiment, a radial pipe is shortened to such an extent that it can be slid into the housing from one of the housing ends together with the insert. The housing jacket itself is cut out around the pipe. The cutout is then closed with a concave closing panel adapted to the shape of the cutout and with an opening in the radial pipe. This closing panel is applied as soon as the insert is slid in. Then the closing panel is joined gas-tight with the housing jacket as well as with the radial pipe, preferably welded. The end of the radial pipe projects adequately beyond the closing panel such that pipes extending further can be attached here. Through the concave design of the closing panel, the pipe end in the center is displaced toward the inside, so that a pipe extending further can be inserted into this trench.

In an embodiment, the housing is a coil housing.

According to a further embodiment of the invention, the closing panel can be dimensioned as a housing stiffener. This is particularly useful if the housing jacket is made of extra-thin sheet metal on the basis of a so-called light construction mode.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
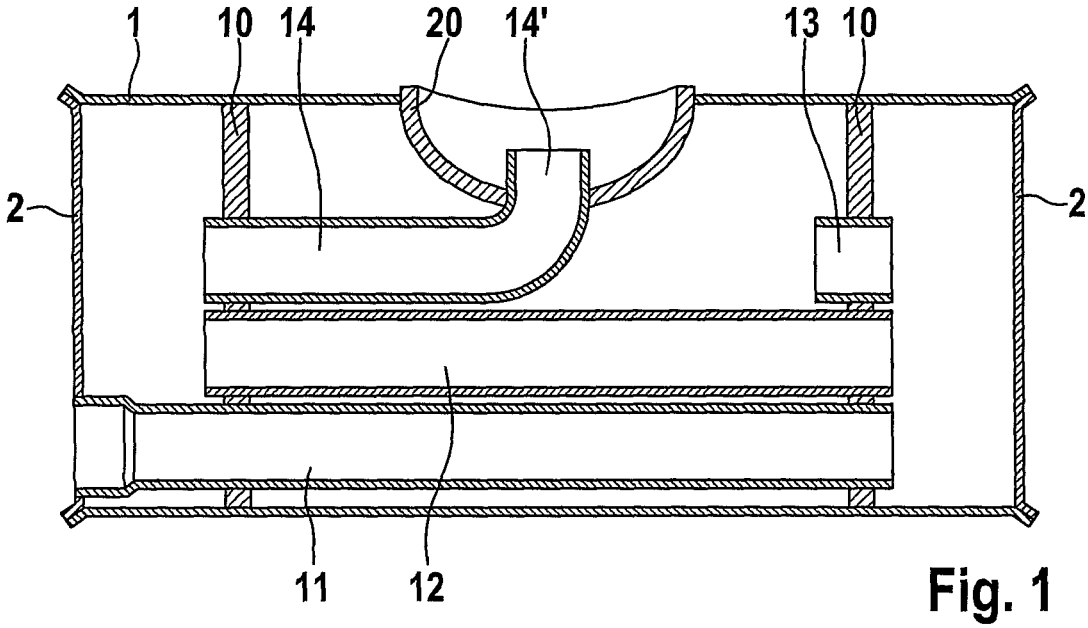
FIG. 1 illustrates a side view of a flue gas muffler with opened housing.
Figure 2:
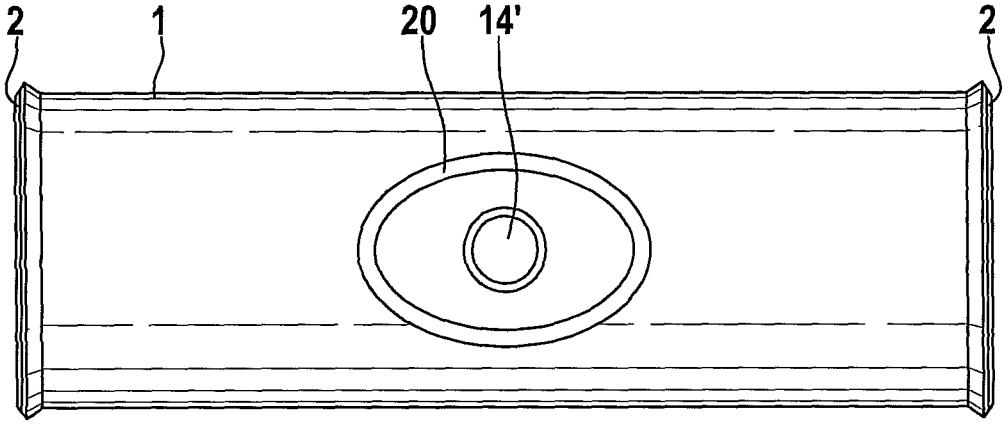
FIG. 2 is a top view of the flue gas muffler of FIG. 1.

FIG. 1 is a cutaway side view and FIG. 2 is a top view that illustrates a flue gas sound damper as an example embodiment for a housing in flue gas units.

The housing itself includes a housing jacket 1, here with an oval cross-section, and is closed gas-tight with a front-end panel and a rear end panel 2. In the interior of the housing one can see an acoustically active insert, having two retaining panels 10, an inlet pipe 11, an intermediate pipe 12, a coupling pipe 13 and an outlet pipe 14. The outlet pipe 14 has a radially directed pipe end 14'. The pipe end 14' is shortened such that the complete insert 10 . . . 14' as a whole, or optionally in pieces, can be slid from one open end of the housing into the housing jacket 1.

As FIG. 1 shows, the housing jacket 1 is cut out in the area of the pipe end 14'. The cutout is closed off by a closing panel 20. This closing panel 20 has a concave shape adapted to the shape of the cutout and an opening for the pipe end 14'. Because of the concave form, the center of the closing panel 20 dips so deeply into the housing that the pipe end 14' projects toward the outside, so that a further extending pipe (not shown) can be attached.

The closing panel 20 itself is connected gas-tight both with the housing jacket 1 and with the pipe end 14', preferably welded, but can be attached by any means known to one skilled in the art. Because of its special shape, the closing panel 20 is highly stable. Because of its positioning, therefore, it can optimally stiffen the housing jacket 1, so that the possibility exists of making the housing jacket 1 itself from a metal sheet which is thinner than would be necessary if the closing panel 20 were not provided.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A housing for a flue gas unit, the housing comprising:

a housing jacket closed gas-tight with a front-end panel and a rear-end panel and a concave closing panel; and an insert having an inlet pipe, an outlet pipe, and retaining walls, the outlet pipe having a radial pipe-end configured to exit the housing jacket radially, wherein the housing jacket includes a cutout around the outlet pipe, the cutout being closed by the concave closing panel fitted to the shape of the cutout, and the closing panel has an opening for the radial pipe end, wherein the closing panel forms a gas-tight joint with the radial pipe-end of the outlet pipe, and wherein the radial pipe-end has a length in a radial direction such that the insert, as a whole or in parts, is slidable into the housing from one housing end in a position between the front-end panel and the rear-end panel.

2. The housing according to claim 1, wherein the closing panel is bowl-shaped.

3. The housing according to claim 1, wherein the radial pipe end of the outlet pipe extends through the closing panel.

* * * * *